US012687093B2

(12) United States Patent
Trushin

(10) Patent No.: US 12,687,093 B2
(45) Date of Patent: Jul. 21, 2026

(54) LOW-COST DOWNHOLE GAS LIFT SYSTEM FOR NON-GAS LIFT TUBING

(71) Applicant: Schlumberger Technology Corporation, Sugar Land, TX (US)

(72) Inventor: Alexander Trushin, Perth (AU)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 19/047,679

(22) Filed: Feb. 7, 2025

(65) Prior Publication Data

US 2025/0257637 A1 Aug. 14, 2025

(30) Foreign Application Priority Data

Feb. 8, 2024 (GB) ..... 2401716

(51) Int. Cl.
*E21B 43/12* (2006.01)

(52) U.S. Cl.
CPC ..... *E21B 43/123* (2013.01); *E21B 43/129* (2013.01)

(58) Field of Classification Search
CPC ..... E21B 43/123; E21B 43/129; C09K 8/38
USPC ..... 166/372
See application file for complete search history.

(56) References Cited

U.S. PATENT DOCUMENTS

| | | | | |
|---|---|---|---|---|
| 3,789,923 A | | 2/1974 | Garrett | |
| 4,237,976 A | | 12/1980 | Wilson | |
| 4,716,970 A | | 1/1988 | Henning | |
| 4,826,406 A | * | 5/1989 | Wells | F04F 1/06 166/372 |
| 11,613,972 B2 | * | 3/2023 | Whiteman | E21B 43/122 166/372 |
| 11,702,913 B2 | * | 7/2023 | Shaw | E21B 43/1235 166/373 |
| 11,753,913 B1 | * | 9/2023 | Turk | E21B 43/122 137/155 |
| 2004/0216886 A1 | | 11/2004 | Rogers | |
| 2021/0189839 A1 | | 6/2021 | Defretin et al. | |
| 2021/0285310 A1 | | 9/2021 | Rowe | |

FOREIGN PATENT DOCUMENTS

| | | | |
|---|---|---|---|
| GB | 2410509 | A | 8/2005 |
| WO | 2005010362 | A2 | 2/2005 |
| WO | 2014098873 | A1 | 6/2014 |
| WO | 2021041178 | A1 | 3/2021 |

* cited by examiner

*Primary Examiner* — William D Hutton, Jr.
*Assistant Examiner* — Ashish K Varma
(74) *Attorney, Agent, or Firm* — Jeffrey D. Frantz

(57) ABSTRACT

A method for gas lifting fluid in a well includes creating an opening at a first depth in a production tubing nested within a casing or liner in the well. A gas lift valve is deployed proximate the opening. A pump is deployed in the production tubing at a second depth shallower than the first depth. Gas is pumped into an annular space between the production tubing and the casing or liner so as to enter the production tubing through the gas lift valve. The pump is operated to lift fluid within the production tubing. The pump is stopped and is then removed from the production tubing when gas lifting of fluid in the well is detected.

12 Claims, 5 Drawing Sheets

LOW-COST DOWNHOLE GAS LIFT SYSTEM FOR NON-GAS LIFT TUBING

CROSS REFERENCE TO RELATED APPLICATIONS

The present application claims priority to United Kingdom patent application No. 2401716.2 that was filed on Feb. 8, 2024, which is herein incorporated by reference in its entirety.

BACKGROUND

This disclosure relates to the field of artificial lift for enhancing fluid production from subsurface wells. More particularly, the present disclosure relates to methods for retrofitting wells with gas lift-type artificial lift devices.

Subsurface wells used to extract fluids such as oil and gas have as a primary source of energy to move fluids to surface the natural fluid pressure in subsurface formations from which the fluids are extracted. FIG. 1 shows an example of a well W in fluid communication with a subsurface formation F from which fluids are to be extracted. The well W may be drilled to a depth to or below the formation F of interest. A protective pipe 100 such as casing or liner may be cemented in place at least through the formation of interest F. A production tubing 102 may be nested within the liner or casing 100. An annular space between the liner or casing 100 and the production tubing 102 may be sealed with an annular sealing element 104 such as a packer. The liner or casing 100 may be perforated as shown at 106 to establish fluid communication between the formation F and the interior of the well W (i.e., the liner or casing 100). The production tubing 102 is typically used to increase the velocity of fluids moving from the formation F to the surface, whereby liquid, e.g., water, may be entrained in the flow of fluid so as to reduce hydrostatic pressure in the well W proximate the formation F, thereby enabling fluids to move to the surface at suitable rates of flow. The casing 100 and production tubing 102 may terminate at the surface in a valve assembly called a wellhead 108, wherein various valves 110 may selectively open and close fluid flow from the production tubing 102, and selectively open and close the annular space between the casing 100 and tubing 102 as may be needed.

In some instances, the natural fluid pressure is insufficient to move fluids to the surface. In other instances, in subsurface formations that initially had sufficient pressure to move fluids to the surface, the formation fluid pressure declines as fluids are extracted. When formation fluid pressure reduces to the point where it cannot overcome the hydrostatic pressure of a liquid column (e.g., oil and/or water), fluid production stalls. In gas producing wells, the liquid loading takes place when the gas rate becomes insufficient to lift water or condensate (natural gas liquids) to the surface. An increasing presence of liquid in the well can create new flow patterns such as churn, slug, and recirculation zones that generate an excess pressure at the formation interface that can hinder or stop gas production. Such conditions require some form of artificial lift to unload the pressure on the formation to keep the well producing.

One of the most efficient and popular tools to address the above problems is gas lifting. Referring to FIG. 2, typically, a gas is injected through the annular space between the casing or liner 100 and the production tubing 102 nested within the casing or liner 100. Gas injected into the annulus passes into the production tubing 102 through several valves 112 installed at different depths along the tubing 102. The number of valves 112 varies depending on well conditions and the capacity of the surface equipment for gas injection. Obviously, the system in FIG. 2 is more complicated in installation and servicing than the system shown in FIG. 1. A well that has not been provisioned for gas lifting will require the original production tubing, e.g., as shown at 102 in FIG. 1, to be removed and the new tubing with gas injection points to be installed. This is a time, risky, and expensive process, in particular because of safety considerations requiring that the well W is never fully open to the atmosphere when there are perforations through the casing or liner 100 as shown in FIGS. 1 and 2. The foregoing requirement necessitates the use of special pressure control equipment, such as a snubbing unit, which makes removal of the production tubing 102 and installation of production tubing with features to receive the valves 112 quite difficult and time consuming.

What is needed is a method for installing and operating gas lift devices in a well without the need to remove the production tubing.

SUMMARY

One aspect of the present disclosure is a method for gas lifting fluids in a well. A method for gas lifting according to this aspect includes creating an opening at a first depth in a production tubing nested within a casing or liner in the well. A gas lift valve is deployed proximate the opening. A pump is deployed in the production tubing at a second depth shallower than the first depth. Gas is pumped into an annular space between the production tubing and the casing or liner so as to enter the production tubing through the gas lift valve. The pump is operated to lift fluid within the production tubing. The pump is stopped and is then removed from the production tubing when gas lifting of fluid in the well is detected.

In some embodiments, detecting gas comprises measuring a property of fluid in the production tubing proximate the pump.

In some embodiments, the property comprises density, acoustic attenuation and/or acoustic velocity.

In some embodiments, deploying a gas lift valve comprises moving a gas lift valve straddle proximate the opening, the gas lift straddle comprising a mandrel and at least two axially spaced apart annular seals disposed on the mandrel.

In some embodiments, the pump comprises an electric submersible pump.

In some embodiments, deploying the pump comprises attaching the pump to an end of an electrical cable and extending the pump and electrical cable into the well from within the production tubing.

In some embodiments, an annular seal is disposed between the production tubing and the liner or casing at a depth in the well above perforations in the casing or liner. The perforations make hydraulic connection between a fluid producing formation and an interior of the casing or liner, and the opening at the first depth is disposed above the annular seal.

Some embodiments further comprise determining whether flow in the production tubing continues after switching off the pump before removing the pump from the well.

In some embodiments, the determining whether flow continues comprises making measurements with at least one sensor associated with the pump.

In some embodiments, the at least one sensor comprises a flow meter.

In some embodiments, the flow meter comprises one or more of a spinner flow meter, a hot wire anemometer or a Coriolis effect flow meter.

In some embodiments, the detecting gas comprises making measurements of rotational speed and/or electric current draw of the pump.

Other aspects and possible advantages will be apparent from the description and claims that follow.

DETAILED DESCRIPTION

Figure 1:
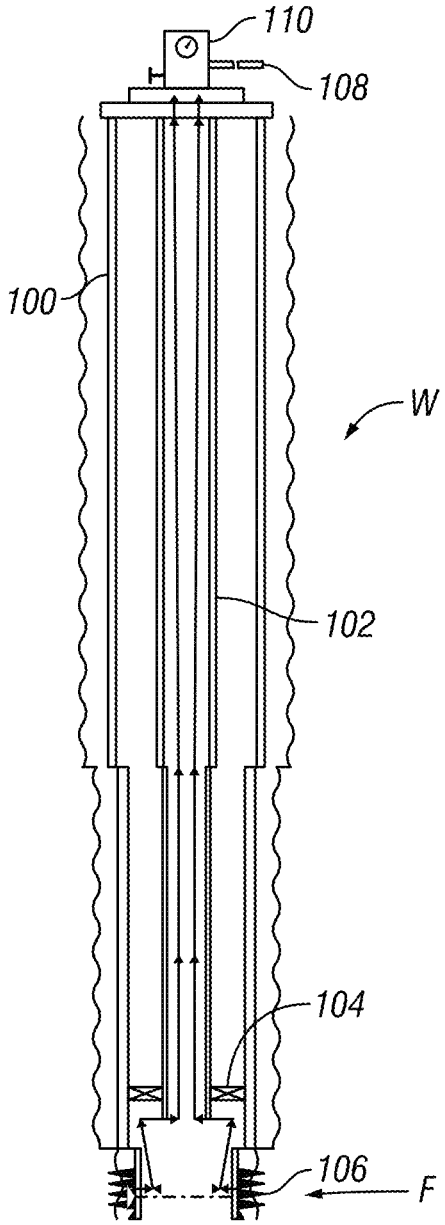
FIG. 1 (Prior Art)
FIG. 1 shows an example well that is completed for fluid production using natural fluid pressure in a subsurface formation.
Figure 2:
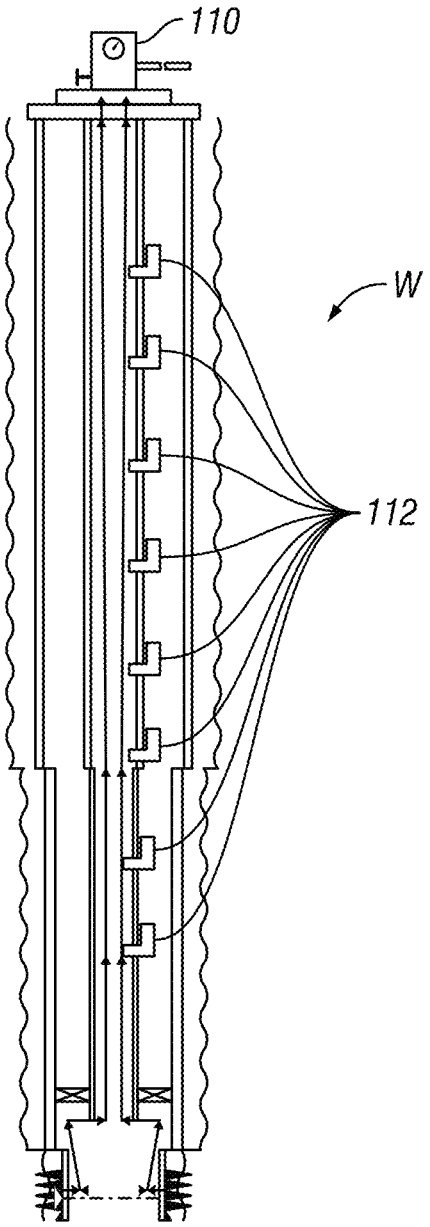
FIG. 2 (Prior Art)
FIG. 2 shows an example well having gas lift valves to enhance fluid production when natural pressure is insufficient to lift fluids to the surface.
Figure 3A:
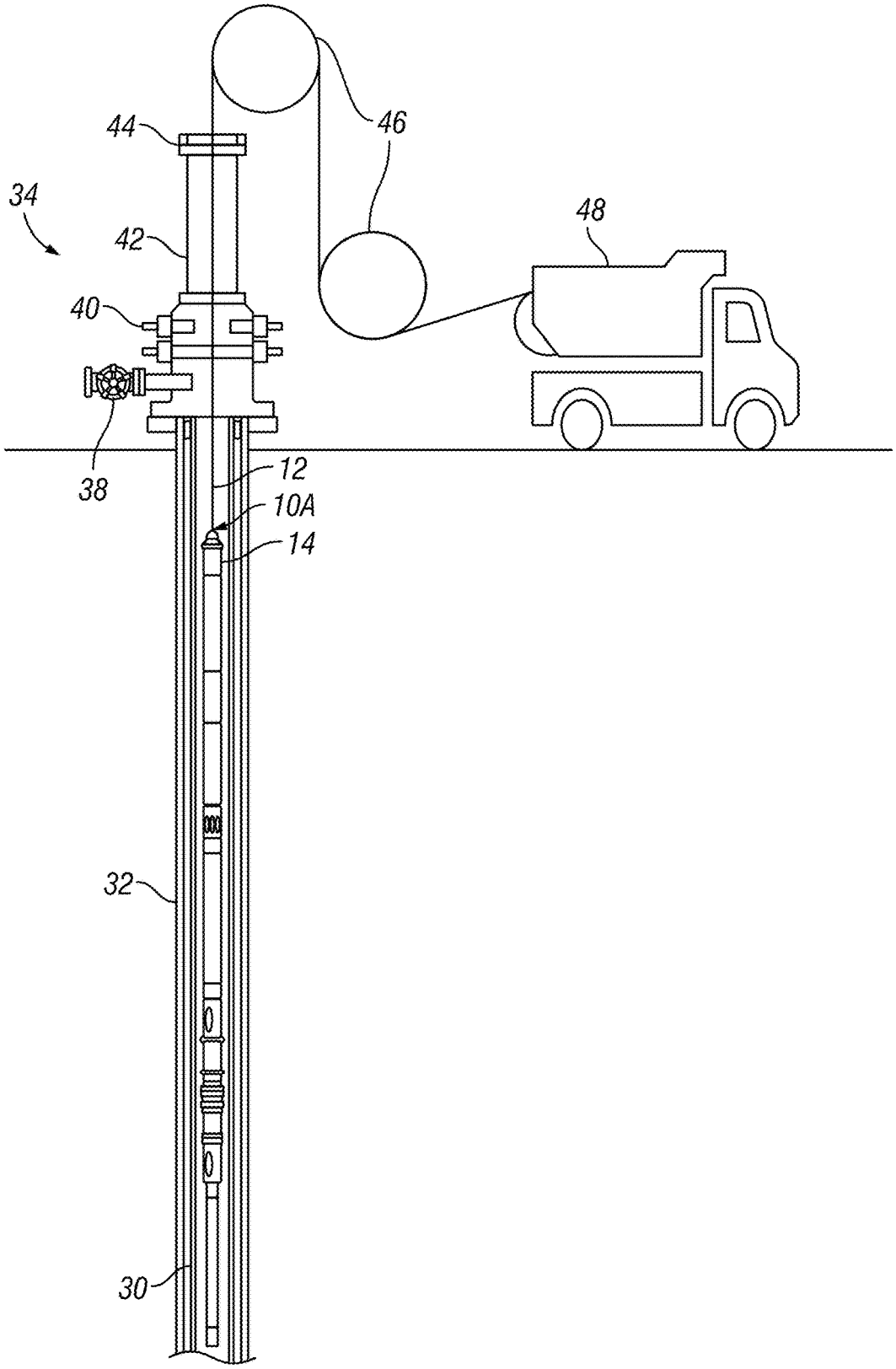
FIGS. 3A and 3B show using a winch having electrical cable to deploy various devices in a well.
Figure 3B:
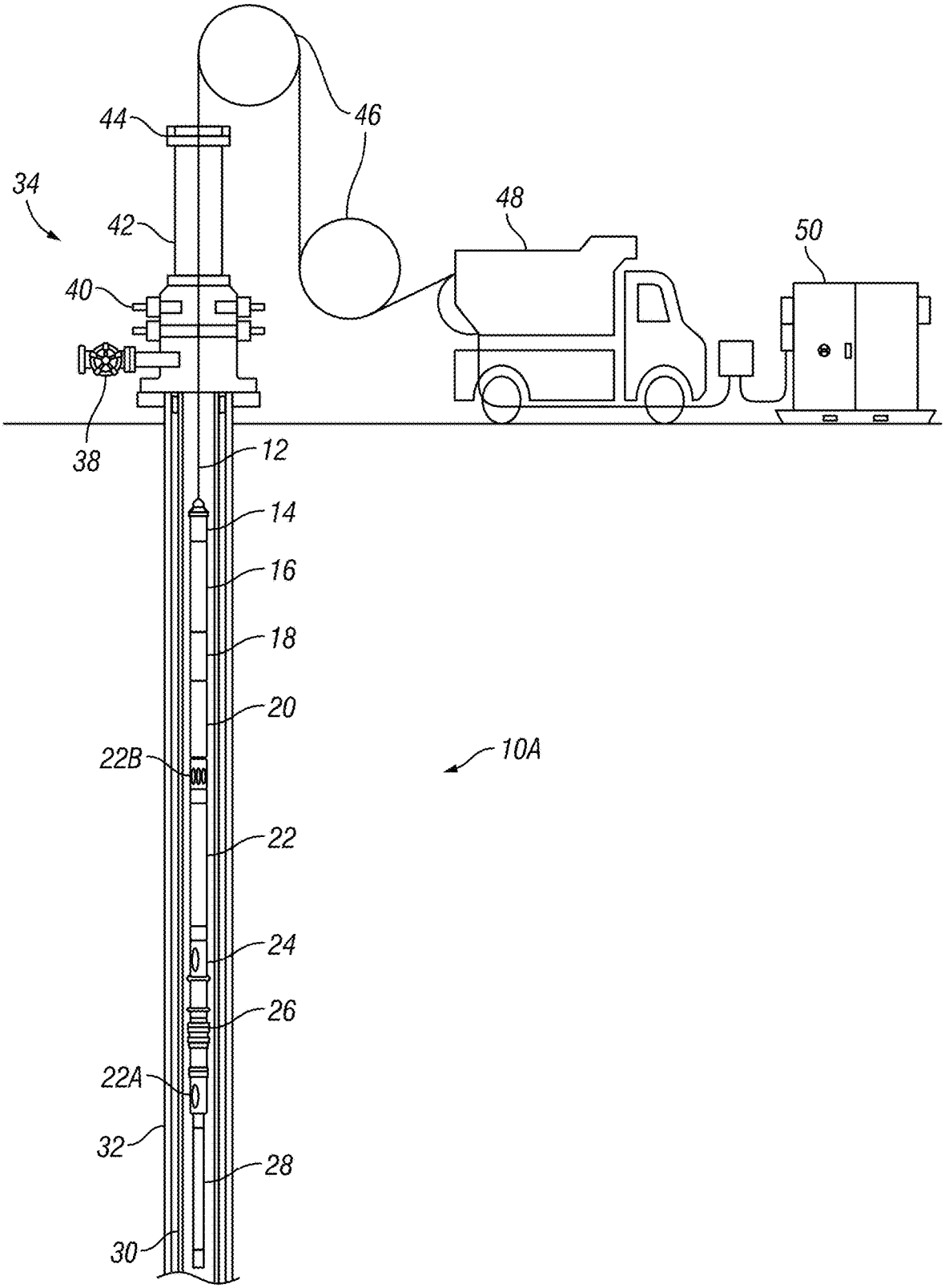

FIGS. 3A and 3B show deploying various intervention instruments and/or tools in a well. Certain devices may be used in connection with such deployment irrespective of the type of instruments or tools, and such devices will be shown in each of FIGS. 3A, 3B as having like reference numerals. FIG. 3A shows an example embodiment of a certain type of tool assembly ("assembly") 10A in accordance with the present disclosure. The assembly 10A in one part of a method according to the present disclosure may comprise an explosive shaped charge perforating gun, a chemical cutter, a drill, a mill or any other device that can make one or more openings ("perforation" or "perforations") in a production tubing, explained further below.

Figure 4:
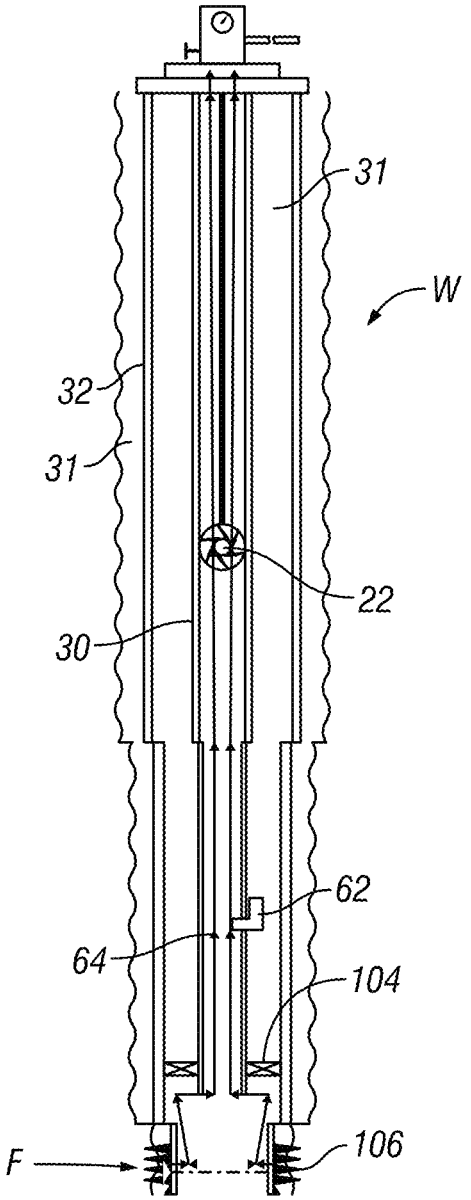
FIG. 4 shows a schematic diagram of a well having a retrofit gas lift valve installed and a pump operated to hydraulically unload the well.
Figure 5:
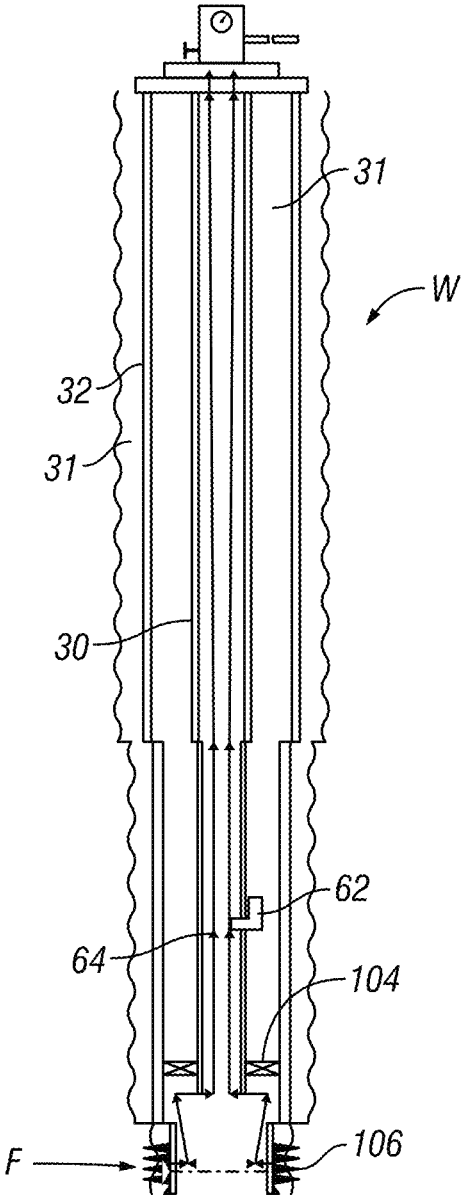
FIG. 5 shows the well of FIG. 4 after removal of the pump in order to produce fluid using only gas lift to supplement natural formation pressure.

The assembly 10A may be deployed in the subsurface well W drilled through fluid bearing underground earthen formations (F in FIGS. 4 and 5). The well W may comprise a protective pipe or casing 32 extending from a valve assembly ("wellhead") 34 coupled to a surface end of the casing 32, it being understood that the term "liner" (a protective pipe not extending to the surface) is within the scope of the present disclosure with reference to the casing 32. A string of smaller diameter conduit ("production tubing") 30 may be nested within the casing 32 and provide a smaller cross section conduit than the casing 32 to increase the velocity at which fluids move to the surface to facilitate fluid production, e.g., by entraining higher density fluids such as water within the flow of lower density fluids such as oil and/or gas.

The wellhead 34 may be disposed at the surface end of the production tubing 30 and may comprise one or more valves, e.g., at 38 to enable fluids moving up the production tubing 30 to leave the well W in a controlled manner. When well intervention devices such as the assembly 10A are moved into a well, safety considerations usually require that a pressure control device such as a blowout preventer (BOP) stack 40 is coupled above the wellhead 34 to provide positive closure of the well W in the event of uncontrolled flow of fluid taking place. A conduit called a lubricator 42 may couple to the top of the BOP stack 40 to provide a sealed enclosure for the assembly 10A in order to introduce the assembly 10A into the well W so as to prevent the well W from being exposed at any time. A pack off or grease injection head 44 may be coupled to the top of the lubricator 42 and used to seal against an electrical cable 12 used to deploy the assembly 10A in the well W, while enabling movement of the electrical cable 12 and thereby the assembly 10A along the well W as may be needed. The assembly 10A may be coupled to the electrical cable 12 by a cable head 14 of types well known in the art.

The electrical cable 12 may transmit electrical power to operate the assembly 10A and may communicate signals from various measuring instruments (not shown separately) which may be associated with the assembly 10A as it is operated in the well W. In the event the assembly 10A comprises one or more of the perforating devices explained above, the electrical cable 12 may provide electrical power to actuate the foregoing when the assembly 10A is disposed at a predetermined depth in the production tubing 30.

The electrical cable 12 may be extended from and retracted onto a winch 48 of types well known in the art in order to move the assembly 10A within the well W.

In some embodiments, the assembly 10A may also comprise a gas lift valve, of a type that will be further explained below with reference to FIG. 6 and in such cases, both making an opening in the production tubing 30 and setting a gas lift valve may be performed in the well in the same intervention operation. In some embodiments, the assembly 10A may comprise only the perforating device. In such cases, the assembly 10A may be changed after the perforation or opening is created in the production tubing 30. In such cases, the assembly may be removed from the well W, the assembly 10A may be changed to include the gas lift valve (e.g., FIG. 6) and the gas lift valve may then be run into the production tubing 30 and set at or proximate the depth of the perforation. Either of the foregoing implementations is within the scope of the present disclosure.

After the gas lift valve e.g., (FIG. 6) is set as explained above, and referring to FIG. 3B, the assembly 10 may be changed to comprise a pump, as will be explained further below. The changed assembly 10 may be connected to the cable head 12 and deployed in the well in a manner similar to that explained with reference to FIG. 3A. A surface end of the electrical cable 12 may in such instance be electrically connected to a surface system 50 of types well known in the art used in connection with electric submersible pumps (ESPs). The surface system 50 may comprise (not shown separately) pump speed control devices such as a variable frequency drive and/or devices to detect measurements made by various sensors in a sensor package 18. In FIG. 3B, as well as FIG. 3A, the electrical cable 12 may pass through one or more sheaves 46 between the winch 48 and the well W in order to direct the electrical cable 12 properly to move the assembly 10 freely along the interior of the well W.

The assembly 10, as previously explained with reference to FIG. 3A, may be coupled to the electrical cable 12 by a cable head 14 of types well known in the art.

When the assembly 10 comprises the pump 22, the following description may apply. The assembly 10 may comprise an electric motor 16 such as a permanent magnet motor rotationally coupled, through a protector assembly 20 and the previously described sensor package 18, to a pump 22 such as a centrifugal pump. An inlet 22A to the pump 22 may be disposed proximate a lower end of the assembly 10, at least disposed below a resettable annular seal ("packer") 26 disposed along the assembly 10. A discharge 22B of the pump 22 may be disposed on an opposed axial side of the resettable packer 26. Thus, flow from the pump 22 is constrained to move upwardly in the production tubing 30. A bypass valve 24 may be provided in the assembly 10 for circumstances wherein flow from parts of the well W below the resettable packer 26 exceeds the flow rate of the pump 22. Such flow may move through the bypass valve 24 upwardly through the production tubing 30.

The resettable packer 26 may comprise an inflatable seal, or may comprise a J-slot mechanism (not shown) to set the packer 26 in a desired axial position in the production tubing 30. The J-slot mechanism may be operated by lifting and lowering the electrical cable 12. A seal element (not shown), in the resettable packer 26 may be energized using the weight of the assembly 10 alone, that is, to activate the seal element (not shown) the electrical cable 12 is unspooled from the winch 48 after the J-slot mechanism sets, such that the weight of the assembly 10 will be applied to the resettable packer 26 to activate the seal element (not shown). When it is desired to release the resettable packer 26 to move the assembly 10, the electrical cable 12 may be spooled onto the winch 48 to lift the assembly 10 and relieve weight from the resettable packer 26. The resettable packer 26 may be configured to resist forces bi-directionally, preventing differential pressure (blow-out) or other unwanted movement of the assembly 10 along the production tubing 30. The resettable packer 26 may be configured to resist blowout, e.g., by providing additional gripping elements ("slips") to engage the interior of the production tubing 30 when the resettable packer 26 is released (unset) if naturally produced fluid causes sufficient upthrust on the assembly 10. The resettable packer 26 in some embodiments may comprise any mechanism to radially expand gripping elements (not shown separately) arranged to axially lock the assembly 10 into position within the production tubing 30, and to actuate the seal element, that is not operated by fluid pressure (i.e., an inflatable packer).

In some embodiments, production logging sensors 28 may be coupled to the assembly 10 at a selected axial position, such as below the resettable packer 26 as shown in FIG. 3B. The production logging sensors 28 may comprise at least a sensor responsive to the presence of gas bubbles in fluid being moved through the production tubing 30 when the pump is operated and when gas is injected into a gas lift valve, to be explained further with reference to FIGS. 4 and 5. Example embodiments of such sensors may comprise, without limitation density sensors, acoustic attenuation sensors and acoustic velocity (travel time) sensors.

In an example embodiment of a method according to the present disclosure, and referring to FIG. 4, the assembly (10A in FIG. 3A) may comprise any form of device used to create one or more perforations 64 in the production tubing 30. In some embodiments, the assembly (10A in FIG. 3A) may be withdrawn from the well, and a device comprising a gas lift valve, e.g., a gas lift straddle 62 may be affixed to the cable head (14 in FIG. 3A) and lowered to the depth of the perforation(s) 64. The cable head (14 in FIG. 3A) may then be disconnected from the gas lift straddle 62 and the cable (12 in FIG. 3A) and cable head (14 in FIG. 3A) may be withdrawn from the well. Then the assembly (10 in FIG. 3B), comprising an ESP system as explained with reference to FIG. 3B may be connected to the cable head (14 in FIG. 3B), deployed in the well and set (by setting the resettable packer 26) at a selected depth in the well W. The pump (22 in FIG. 3B) may then be started. Contemporaneously, gas, e.g., nitrogen, may be pumped into the annular space 31 such that the gas lift valve (e.g., on the straddle 62) opens and gas begins to flow into the production tubing 30. The selected depth for deploying the pump (22 in FIG. 3B) may depend on parameters such as the density of fluid in the well W prior to gas lift, the density of the fluid produced from the formation F, among other parameters.

Measurements from the production logging sensors (28 in FIG. 3B), if included in the assembly (10 in FIG. 3B), may be used to determine when gas pumped through the gas lift valve (e.g., in the straddle 62) reaches the pump intake (22A in FIG. 3B), and when fluid production is stable by reason of gas lift. At such time, the pump (22 in FIG. 3B) may be stopped and the assembly (10 in FIG. 3B) may be withdrawn from the well W. It will be appreciated that when the pump (22 in FIG. 3B) comprises a bypass valve (24 in FIG. 3B) as previously explained with reference to FIG. 3B, fluid flowing upwardly in the production tubing 30 as a result of gas lift may continue flowing even when the pump 22 is switched off. In some embodiments, the production logging sensors (28 in FIG. 3B) may comprise one or more flow meters, e.g., a spinner flow meter, Coriolis effect flow meter or hot wire anemometer. Measurements from the flow meter may be used to confirm that fluid flow in the production tubing continues after the pump (22 in FIG. 3B) has been switched off. If fluid movement stops after the pump (22 in FIG. 3B) is switched off, an injection rate of gas through the gas lift valve may be increased and the pump restarted. Fluid movement may be reconfirmed after stopping the pump (22 in FIG. 3B). The foregoing may be repeated at successively higher gas injection rates until stable fluid movement by gas lift is determined. The pump (22 in FIG. 3B) may then be switched off and withdrawn from the well. In some embodiments, fluid movement by reason of gas lift may be determined by detecting gas bubbles in the well fluid proximate the surface (e.g., in the wellhead).

The assembly (10 in FIG. 3B) may thus be withdrawn from the well W while fluid flow continues upwardly in the production tubing 30. Referring to FIG. 5, after the assembly (10 in FIG. 3B) is withdrawn from the well W, producing fluids to the surface may continue by way of gas being pumped through the gas lift valve (e.g., the straddle 62) to relieve hydrostatic pressure in the well W proximate the formation F.

In some embodiments, detecting gas proximate the pump inlet as an indicator of fluid movement may comprise making measurements of the pump rotational speed and/or electric current load from the pump 22. Sensors for making such measurements are typically included in the monitoring package (18 in FIG. 3B) of ESPs. In such embodiments, the pump 22 may omit the production logging sensors (28 in FIG. 3B). Indications of gas bubbles reaching the pump inlet may include increased pump rotation speed and/or reduced current draw. Such measurements continued over time may be used to establish stable fluid production by reason of gas lift, at which time the pump (22 in FIG. 3B) may be stopped and the assembly (10 in FIG. 3B) withdrawn from the well W.

Figure 6:
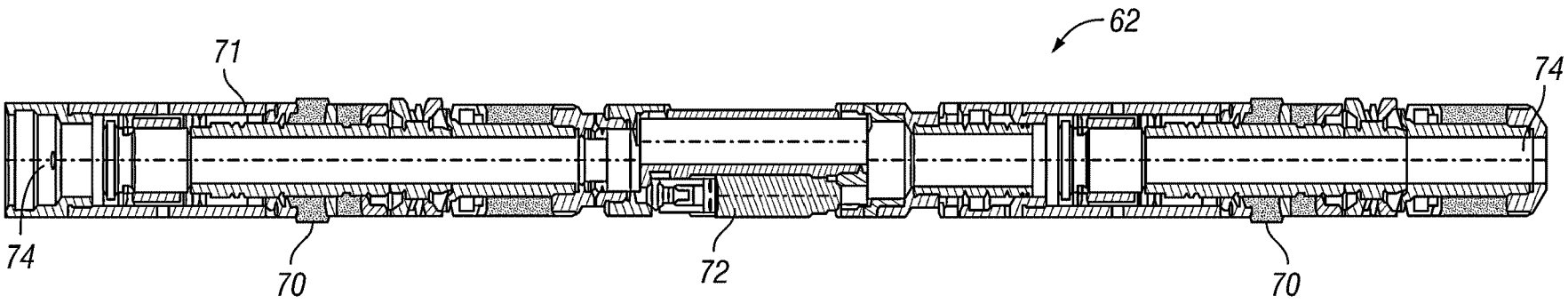
FIG. 6 shows an example embodiment of a gas lift valve that may be installed in a production tubing not originally configured for gas lift that may be used in accordance with the present disclosure.

An example embodiment of a gas lift valve, which may in some embodiments form part of a gas lift straddle, is shown schematically in FIG. 6. The gas lift straddle 62 may comprise a mandrel 71 having a diameter enabling through passage along the interior of the production tubing (30 in FIG. 4). The mandrel may comprise longitudinally spaced apart annular seals 70, which act to seal an annular space between the mandrel 71 and the interior of the production tubing (30 in FIG. 4) when actuated. A gas lift valve 72 may be disposed along the mandrel 71 between the annular seals 70, and have an operating port in fluid communication with the interior of the production tubing (30 in FIG. 4). A discharge port on the gas lift valve may be in communication with a through passage 74 inside the mandrel 71, such that gas from the annular space (31 in FIG. 5) may be introduced into a fluid flow stream passing through the through passage 74, thus providing gas lift. A non-limiting example type of gas lift straddle is available commercially from Peak Well Systems, Pty Ltd., Perth, Western Australia. As explained above, the gas lift straddle 62 may form part of the assembly (10A in FIG. 3A) deployed in the well at the same time as the perforating apparatus, or it may be deployed in the well subsequent to perforating the production tubing in a separate intervention operation in the well from the perforating methods according to the present disclosure and associated apparatus may enable installing gas lift into a well that was not originally configured for gas lift without the need to remove the production tubing, and correspondingly to kill the well or use snubbing equipment to pull and reinstall tubing in a live well.

In light of the principles and example embodiments described and illustrated herein, it will be recognized that the example embodiments can be modified in arrangement and detail without departing from such principles. The foregoing discussion has focused on specific embodiments, but other configurations are also contemplated. In particular, even though expressions such as in "an embodiment," or the like are used herein, these phrases are meant to generally reference embodiment possibilities, and are not intended to limit the disclosure to particular embodiment configurations. As used herein, these terms may reference the same or different embodiments that are combinable into other embodiments. As a rule, any embodiment referenced herein is freely combinable with any one or more of the other embodiments referenced herein, and any number of features of different embodiments are combinable with one another, unless indicated otherwise. Although only a few examples have been described in detail above, those skilled in the art will readily appreciate that many modifications are possible within the scope of the described examples. Accordingly, all such modifications are intended to be included within the scope of this disclosure as defined in the following claims.

What is claimed is:

1. A method for gas lifting a fluid in a well, comprising:

determining, via a sensor package including a flow meter, a flow rate within a production tubing, the sensor package in communication with a pump;

creating, via a perforating device, an opening at a first depth in the production tubing nested within a casing or liner in the well;

deploying a gas lift valve proximate the opening;

deploying the pump in the production tubing at a second depth shallower than the first depth;

pumping gas into an annular space between the production tubing and the casing or liner so as to enter the production tubing through the gas lift valve;

operating the pump to adjust the flow rate within the production tubing;

detecting, via a production logging sensor positioned below the sensor package in communication with the pump, a presence of bubbles lifting the fluid within the production tubing;

stopping the pump in response to an increase of the flow rate; and removing the pump from the production tubing when gas lifting of the fluid in the well is detected.

2. The method of claim 1, wherein detecting the presence of bubbles lifting the fluid within the production tubing comprises measuring a property of fluid in the production tubing proximate the pump.

3. The method of claim 2, wherein the property comprises at least one of density, acoustic attenuation, or acoustic velocity.

4. The method of claim 1, wherein deploying a gas lift valve comprises moving a gas lift valve straddle proximate the opening, the gas lift valve straddle comprising a mandrel and at least two axially spaced apart annular seals disposed on the mandrel.

5. The method of claim 1, wherein the pump comprises an electric submersible pump.

6. The method of claim 1, wherein deploying the pump comprises attaching the pump to an end of an electrical cable and extending the pump and the electrical cable into the well from within the production tubing.

7. The method of claim 1, wherein an annular seal is disposed between the production tubing and the liner or casing at a depth in the well above perforations in the casing or liner, the perforations making hydraulic connection between a fluid producing formation and an interior of the casing or liner, and wherein the opening at the first depth is above the annular seal.

8. The method of claim 1, further comprising determining whether flow in the production tubing continues after switching off the pump before removing the pump from the well.

9. The method of claim 8, wherein determining whether flow continues comprises making measurements with the sensor package and the production logging sensor associated with the pump.

10. The method of claim 1, wherein the flow meter comprises one or more of a spinner flow meter, a hot wire anemometer and a Coriolis effect flow meter.

11. The method of claim 1, wherein detecting gas comprises making measurements of at least one of a rotational speed or electric current draw of the pump.

12. The method of claim 1, wherein the production logging sensor includes a flow meter, a density sensor, an acoustic attenuation sensor, an acoustic velocity, a sensor, or a combination thereof configured to detect the presence of gas bubbles in the fluid being moved through the production tubing when the pump is operated and when the gas is injected into the gas lift valve.

* * * * *